United States Patent [19]

Brueck

[11] Patent Number: 4,951,421

[45] **Date of Patent: * Aug. 28, 1990**

[54] DEVICE FOR CENTERING OF OPTIC LENSES IN A MECHANICAL MOUNTING, IN PARTICULAR DURING EDGE CUTTING AND BEVELLING

[75] Inventor: Erhard Brueck, Heuchelheim, Fed. Rep. of Germany

[73] Assignee: Wilhelm Loh Wetzlar Optikmaschinen GmbH & Co. KG, Wetzlar, Fed. Rep. of Germany

[ * ] Notice: The portion of the term of this patent subsequent to Jul. 17, 2007 has been disclaimed.

[21] Appl. No.: 289,920

[22] Filed: Dec. 23, 1988

[30] Foreign Application Priority Data

Dec. 24, 1987 [DE] Fed. Rep. of Germany ..... 3744115

[51] Int. Cl.[5] ..... B24B 5/04; B24B 9/14; B23B 19/02; B23B 23/04

[52] U.S. Cl. ..... 51/105 LG; 51/162; 51/217 T; 51/217 L; 82/147; 82/151; 82/170; 384/1; 384/118

[58] Field of Search ..... 51/105 LG, 106 LG, 162, 51/217 L, 217 T, 237 R, 277; 82/122, 147, 151, 165, 170, 904; 384/1, 118

[56] References Cited

U.S. PATENT DOCUMENTS

| | | | |
|---|---|---|---|
| 2,508,009 | 5/1950 | Bonin | 51/217 T |
| 2,660,484 | 11/1953 | Gerard et al. | 384/118 |
| 2,663,977 | 12/1953 | Gerard et al. | 82/147 |
| 3,143,382 | 8/1964 | Ertaud et al. | 384/118 |
| 3,599,377 | 8/1971 | Dartnell | 51/277 |
| 3,732,757 | 5/1973 | Cottin | 82/147 |
| 3,750,344 | 8/1973 | Raphael | 51/105 LG |
| 4,434,581 | 3/1984 | Spriggs | 51/67 |
| 4,612,736 | 9/1986 | Massard et al. | 51/105 LG |
| 4,809,466 | 3/1989 | Junker | 51/217 T |

FOREIGN PATENT DOCUMENTS

| | | | |
|---|---|---|---|
| 1004516 | 8/1957 | Fed. Rep. of Germany . | |
| 2148102 | 11/1978 | Fed. Rep. of Germany . | |
| 3139873 | 4/1983 | Fed. Rep. of Germany . | |
| 231269 | 11/1968 | U.S.S.R. | 384/1 |

*Primary Examiner*—William Terrell

*Attorney, Agent, or Firm*—Flynn, Thiel, Boutell & Tanis

[57] ABSTRACT

To center optic lenses in a mechanical mounting, in particular during edge cutting and bevelling, the invention includes a device with a housing (10), in which a motor drive (M, R) acts through a torque part (50), drive shafts (14, 14') and drive elements (16, 16') onto aligned centering spindles (18, 18'). These are arranged in guide bearings (22, 22') on projecting parts of the C-shaped housing (10) and are constructed as air bearings. In this manner, it is possible to hold the clamping angle ($\alpha$) on the lens (L) in the range below $2\times8°$, preferably below $2\times6°$. In particular the lower centering spindle (18) is smoothly axially adjustable in the air bearing (22), for which purpose axially parallel and/or partial-ring-shaped grooves (90) are provided at the ends of a thin-wall guide sleeve (76), between which ends peripheral air-cushion fields build up when pressurized air is being supplied. The axial closing of the clamping spindle (18) is done by a clamping device (24) having a crossbar plate (26) and a membrane piston (32).

6 Claims, 4 Drawing Sheets

A
16´
82
74a
22´
78
80
C
76
10
18´
19´
74b
20´
L
α
20

20´
α
20
L
18
84b
19
90
100´
(10)
95
Ai
Ai
98
88
22
95
86
Bi
Bi
90
95
84a
35
82
16
36
37
34
26
32
A

Fig. 4
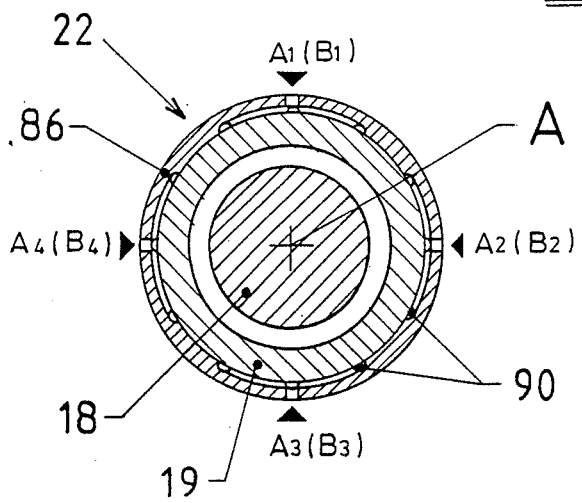
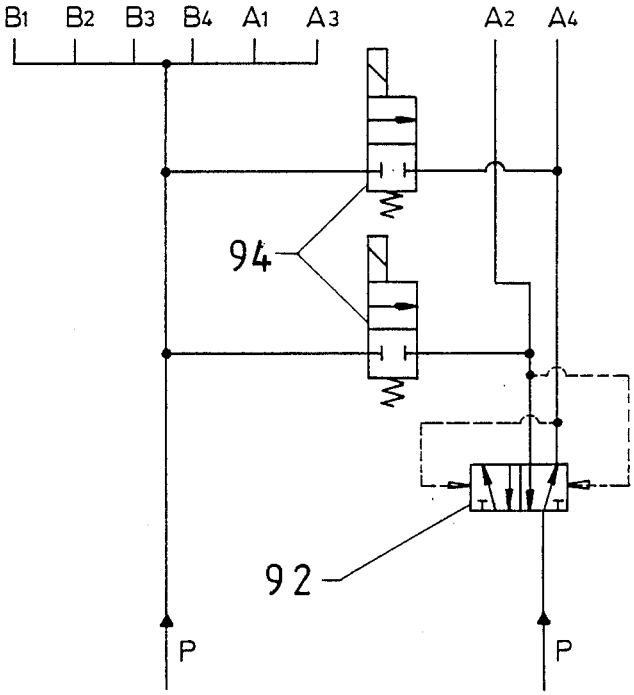
Fig. 5

DEVICE FOR CENTERING OF OPTIC LENSES IN A MECHANICAL MOUNTING, IN PARTICULAR DURING EDGE CUTTING AND BEVELLING

CROSS REFERENCE TO RELATED APPLICATIONS

This application is related to my three copending applications filed concurrently herewith, each application having the same title, but separately identified as Ser. No. 289,903, now U.S. Pat. No. 4,941,291; Ser. No. 289,921; and Ser. No. 289,922, U.S. Pat. No. 4,926,588.

FIELD OF INVENTION

The present invention relates to a device for centering optic lenses in a mechanical mounting, in particular during edge cutting and bevelling of the lens.

BACKGROUND OF THE INVENTION

According to German Pat. No. 1 004 516, the lens is for this purpose clamped at high pressure between two cups, so that its position cannot change by itself. To center the lens, the clamping cups are vibrated by ultrasound during the clamping operation in order to convert the static friction between cup and lens into a lower sliding friction. However, this transition occurred sporadically, which often caused damage to the lens due to an undesired material removal.

Furthermore, an attempt has been made to drive the clamping cups during clamping of the lens in opposite directions of rotation. Here too a high risk exists that lens damage will occur, that is, cutting tracks in the form of rings cut into the surface of the lens can hardly be avoided.

German Auslegeschrift No. 21 48 102 suggests to arrange a piezoceramic case vibrator on the elevationally nonchangeable clamping cup, which case vibrator is electrically controlled by a threshold switch such that the clamping cup force drops off when reaching a pregiven pressure, which causes the vibration generator to be turned off. The piezovibrator is used at the same time to test the clamping pressure, to which the vibrational amplitude is regulated. Electronic instabilities are disadvantageous in this arrangement. Furthermore, the vibrator has a not insignificant sensitivity with respect to axial pressure. An initial stress is created during clamping due to the pressure load; a supporting of the vibrator is therefore problematic.

From German Offenlegungsschrift No. 31 39 873 a device is known in which the irregularities of a gear drive are utilized to produce relative movements between lens and clamping cup. A balanced differential is provided as a compensating device between the two parts of a two-part centering spindle and the drive shaft. A hydraulic clamping cylinder is provided for a pressure plate of the upper, axially movable spindle. Due to the high friction of the clamping spindle in its slide bearing, a precise regulating of the clamping pressure is, however, difficult to realize, so that this device can also only be utilized in a limited way.

An important goal of the invention is, while overcoming the disadvantages of the state of the art, to improve the centering of lenses in particular for the cutting operation at the edge through a significantly improved and smooth guiding of the centering spindles, through increased holding forces and exactness of the clamping, without increasing the static force input, so that mechanical damage to the lens are with certainty avoided.

Each centering spindle is according to the invention supported radially and axially in a sleeve, which in turn can be secured through a hydraulic clamping element in the machine frame. The clamping element consists of a sleeve surrounded by a cavity, the sleeve being deformed upon an increase of the pressure in the cavity and being pressed against the guide sleeve of the centering spindle. The centering spindle is in this manner fixed in axial direction and is at the same time exactly aligned with respect to the axes.

Each air bearing can be integrated in the sleeve, which air bearing surrounds the associated guide sleeve of the centering spindle. The upper centering spindle is axially movable and clampable for setting the machine. An adjusting screw acting as a pressure piston makes it possible to adjust the pressure on the guide sleeve of the so-called fixed spindle as needed without changing its axial alignment.

The centering spindle has an outer sleeve which is snugly guided in the air-bearing sleeve and is supported axially and/or radially at the ends. In particular the lower centering spindle, the so-called clamping spindle, is thus centrally axially guided with a high degree of precision and control. The outer sleeve for the guide sleeve of the clamping spindle sits fixedly in the machine housing and is thereby precisely arranged aligned with respect to the outer sleeve for the guide sleeve of the fixed spindle.

A very advantageous further development of the air bearing consists in providing grooves between the housing and at least the lower guide sleeve of the centering spindle, which grooves can be loaded with pressure medium through control openings. The grooves can form axially parallel and/or partial-ring-shaped channels. The inner wall of the guide-sleeve bore is in a preferred manner designed with channels and pockets such that four separate air-cushion fields are created in the upper and lower half, which fields support the clamping spindle with an extremely stable low friction capability during the supply of pressure-air. The air bearing and the therewith connected guiding capability of the clamping spindle and of the membrane pistons makes it possible to keep the aligning forces for aligning of the lens very small and to facilitate delicate adjustments, thus avoiding damage to the surface of the lens during its aligning movement. When the lens has reached its exact aligned position, the cavity surrounding the clamping sleeve is loaded with high pressure, so that the clamping spindle is precisely centrally axially clamped in its position. The supplied pressurized air also helps very much during the machining operation in order to prevent cooling and cutting means or abrasive material from penetrating between the guide sleeve and the clamping spindle.

BRIEF DESCRIPTION OF THE DRAWINGS

Further characteristics, details and advantages of the invention result from the wording of the claims and from the following description of one exemplary embodiment in connection with the drawings, in which:

FIG. 4 is a further enlarged cross-sectional view taken along the plane Ai—Ai of FIG. 3, and FIG. 5 is a schematic illustration of the pressure-medium control for the arrangement according to FIGS. 3 and 4.

DETAILED DESCRIPTION

Figure 1:
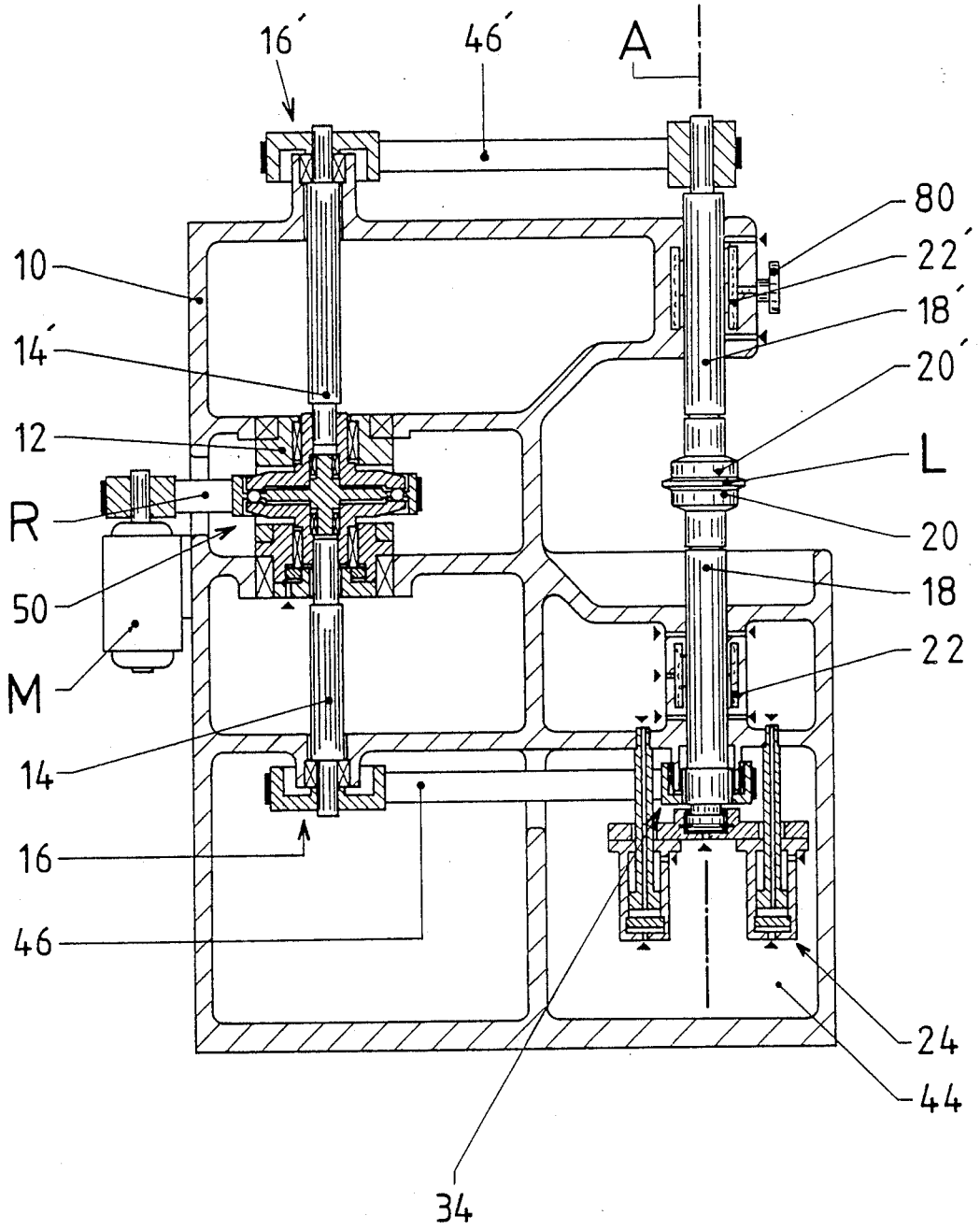
FIG. 1 is a complete axial cross-sectional view of a centering device.

The complete view of FIG. 1 shows a device with a housing 10, which includes a bearing for aligned drive shafts 14, 14', which through drive elements 16, 16' act onto centering spindles 18, 18', which are also aligned with one another. The centering spindles carry at their free ends clamping cups 20, 20', between which a lens L can be aligned and clamped for machining. A motor M is used as a drive, which motor acts through a belt drive R and a torque divider 50 onto the two drive shafts 14, 14'.

A chamber 44 is provided in the lower part of the C-shaped housing 10. A clamping device 24 is housed in the chamber 44. This makes it possible to move the lower centering spindle 18 relative to the upper centering spindle 18' in axial direction A in order to clamp the lens L.

Figure 2:
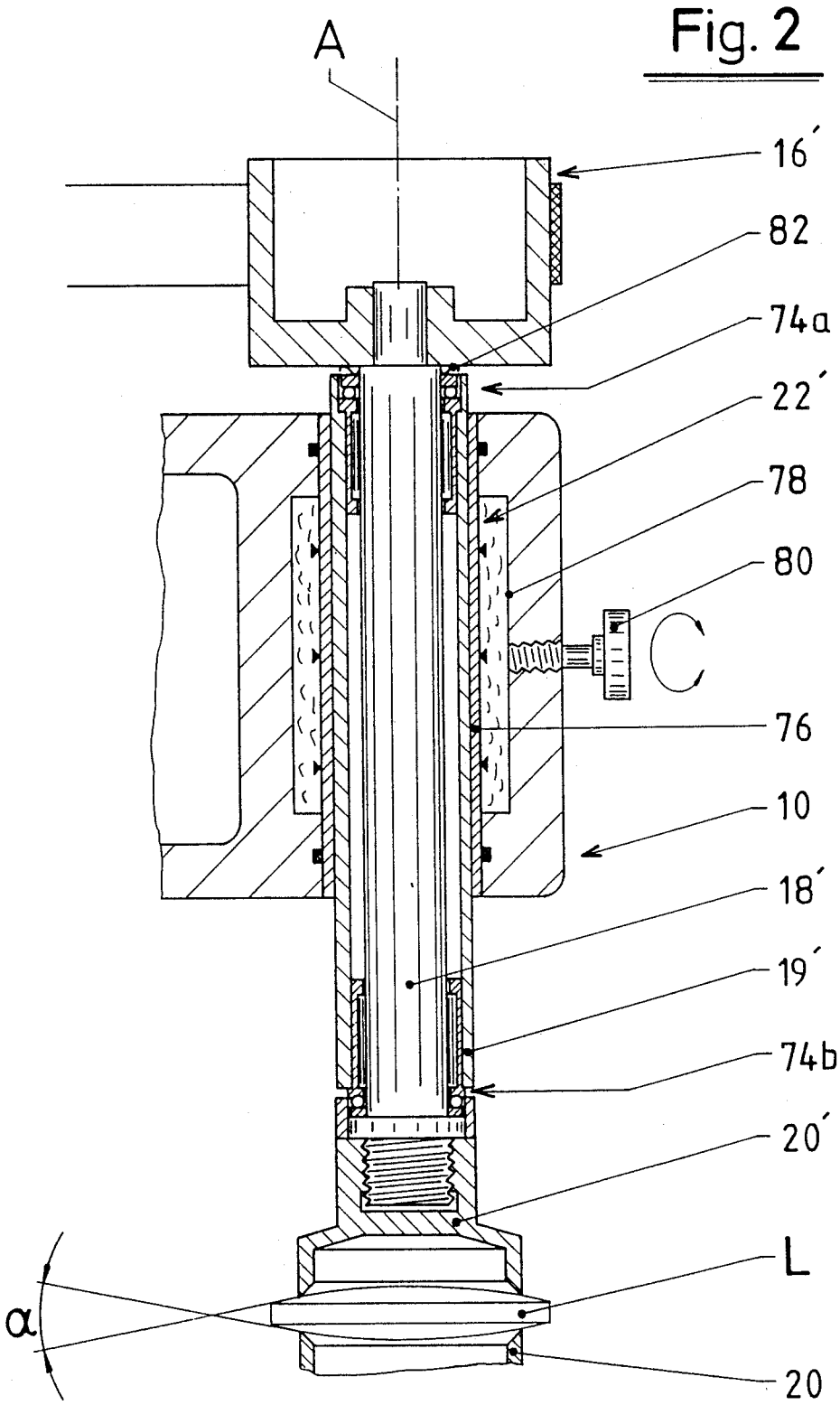
FIG. 2 is an enlarged axial cross-sectional view of an upper centering spindle guideway.

FIG. 2 shows the upper part of the centering spindle arrangement. A clamping bearing 22' for the upper centering spindle 18' is provided in a projecting part of the housing 10. The centering spindle 18' is also identified as a fixed spindle. It has a guide sleeve 19' which is supported radially and axially with respect to the inner centering spindle 18' through support bearings **74*a*, 74*b***.

The clamping bearing 22' is provided in the housing 10 and has a thin-wall sleeve 76 which encloses the centering spindle 18' or its guide sleeve 19' and itself is surrounded by a cavity 78 in which, by means of an adjusting screw 80 acting as a pressure piston, the clamping pressure, corresponding to the respective need, acting on the guide sleeve 76 can be adjusted.

A lens can be clamped with a clamping angle between the upper clamping cup 20' and the lower clamping cup 20. This is the angle which the two tangents assume with respect to one another at the points of contact between the lens surface and the clamping cups 20, 20'. Physically caused by the static friction coefficient, the angle $\alpha$ must be larger than $2\times 8° > 16°$.

Figure 3:
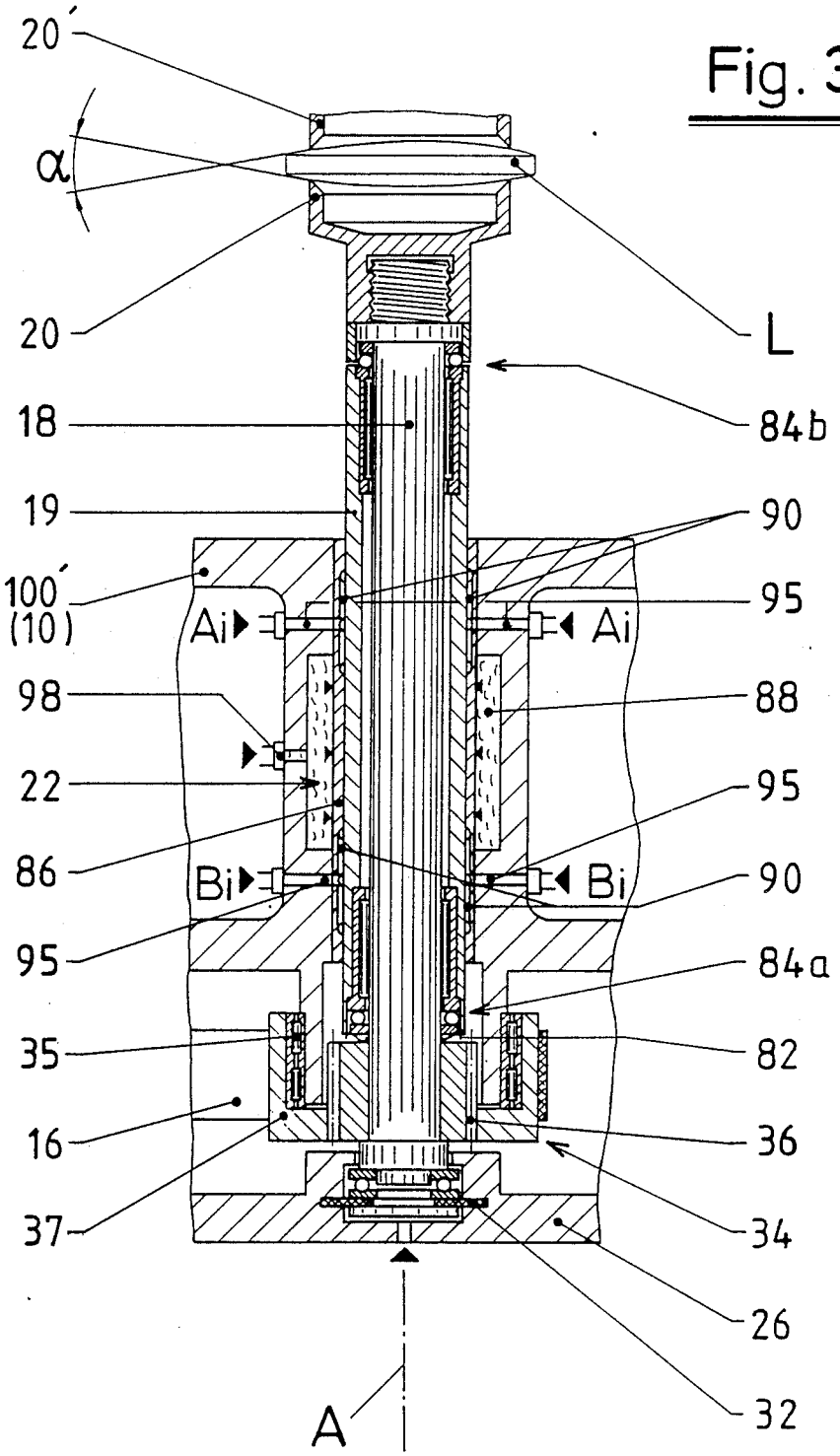
FIG. 3 is an enlarged axial cross-sectional view of a lower centering spindle guideway with a clamping device.

The lower centering spindle arrangement according to FIG. 3 is used for clamping. The lower centering spindle 18, which is also called a clamping spindle, has hereby also a guide sleeve 19 which is supported axially and radially by support bearings **84*a*, 84*b* with respect to the inner, actual centering spindle 18. Between the lower support bearing 84*a* and a flange of a coupling piece 34 there is arranged a spring washer 82 which permits a limited axial movement of the guide sleeve and centering spindle relative to one another. The coupling piece 34 consists of two gears 36, 37 with internal and external tooth systems, with the gear 36 being fixedly connected against rotation relative to the centering spindle 18. The gear 37 is supported on the housing 10 through a radial bearing 35. The gear 36 is so wide that even during the necessary axial movement of the centering spindle, the gears 36, 37 do not disengage. The gear 37 is constructed as a belt pulley on the periphery thereof. The gear element 16** (also a driving belt) engages the belt pulley.

The clamping device 24 has a plate 26 which is constructed as a crossbar. The crossbar 26 has a central cavity with a membrane piston 32 therein. The membrane piston 32 can be moved upwardly by a pressure-medium load in order to lift the clamping spindle 18 together with the lens L, which rests on the clamping cup 20, toward the upper clamping cup 20'.

In order to be able to carry out this closing movement as smoothly as possible, the clamping bearing 22 for the clamping spindle 18 is constructed inventively additionally as an air bearing. Grooves 90 are provided for this purpose on the periphery of the thin-wall guide sleeve 86, in particular at its two ends, which grooves 90 can be loaded with pressure medium through control openings Ai and Bi. From looking at FIG. 4 it can be seen that these grooves 90 are designed as axially parallel and partially-ring-shaped channels, which in particular form four separate air-cushion fields, due to which the centering spindle 18 or rather its outer sleeve 19 is axially movable with very little friction in the clamping bearing 22, assuring at the same time a precise axial alignment of the centering spindle.

The guide sleeve 19 of the clamping spindle 18 is air-supported and guided by the pressure load. The friction for the axial clamping movement is in this manner reduced to a minimum and a high degree of precision in the alignment of the axes is assured at the same time. The aligning forces needed for aligning the lens L can be adjusted precisely by the membrane piston 32. The cavity 88 is, after the alignment, placed under high pressure with a pressure medium applied through the bore 98 and the thin-wall guide sleeve 86 along with the sleeve 19 is deformed toward the center and clamps the clamping spindle in an exact alignment. The clamping force, which is needed for machining of the lens L, is transmitted onto the centering spindle 18 through the crossbar 26 and the axial bearing 33. The so created small axial movement of the clamping spindle 18 occurs in the bearing **84*a* and 84*b* with the spring washer 82** being slightly more tensioned.

All characteristics and advantages, which can be taken from the claims, the description and the drawings, including structural details, spacial arrangements and method steps, can be inventively important both by themselves and also in many different combinations.

The embodiments of the invention in which an exclusive property or privilege is claimed are defined as follows:

1. A device for centering optic lenses in a mechanical mounting for edge cutting and bevelling, comprising:

a housing;

a pair of first guide sleeves supported in said housing;

two coaxially aligned second guide sleeves snugly surrounded by and supported in a respective said first guide sleeve, said first guide sleeves being radially thinner than said second guide sleeves, said second guide sleeves having support bearings disposed therein;

two coaxially aligned centering spindles supported in respective said second guide sleeves on said bearings for rotational movement relative to said respective second guide sleeves, at least one of said centering spindles being supported for limited axial movement relative to the associated said second guide sleeve, said centering spindles having respective ends which face one another, said facing ends carrying clamping cups for clamping a lens therebetween;

drive means for rotating said centering spindles;

clamping means disposed in said housing for moving one said centering spindle axially toward the other said centering spindle; and means in said housing for defining cavities which respectively surround said first guide sleeves such that said cavity defining means and respective said first guide sleeves define respective pressure chambers radially therebetween, means for loading said pressure chambers with a pressurized fluid, each said first guide sleeve being radially inwardly deformable toward a respective said centering spindle in response to a predetermined pressure level in said pressure, whereby said second guide sleeves are grippingly clamped by said first guide sleeves.

2. The device according to claim 1, wherein said housing includes adjusting screw means adjoining said cavity defining means for adjusting the fluid pressure in one of said pressure chambers.

3. The device according to claim 1, wherein at least one of said second guide sleeves is supported in the corresponding said first guide sleeve by at least one air bearing.

4. The device according to claim 3, wherein said at least one air bearing includes means for defining radially inwardly opening grooves in the corresponding said first guide sleeve, and means for defining bores in said housing and said first guide sleeve communicating with said grooves for facilitating a supplying of pressurized fluid to said grooves.

5. The device according to claim 4, wherein said grooves form one of axially parallel extending channels and circumferentially extending channels in the corresponding said first guide sleeve.

6. The device according to claim 4, wherein said housing includes means defining a plurality of control openings communicating with respective said bores in said housing, at least two of said control openings being diametrically opposed, wherein said housing includes a source of said pressurized fluid and means for connecting said pressurized fluid source with each of said control openings, said connecting means including control valve means for selectively connecting said at least two diametrically opposed control openings with said pressurized fluid source, and wherein said housing includes check valve means for isolating said two diametrically opposed control openings from the remaining said control openings and for actuating said control valve means.

* * * * *

UNITED STATES PATENT AND TRADEMARK OFFICE

CERTIFICATE OF CORRECTION

PATENT NO. : 4 951 421

DATED : August 28, 1990

INVENTOR(S) : Erhard BRUECK

It is certified that error appears in the above-identified patent and that said Letters Patent is hereby corrected as shown below:

Column 5, line 14; after "pressure" insert ---chamber---.

Signed and Sealed this

Twenty-sixth Day of May, 1992

*Attest:*

DOUGLAS B. COMER

*Attesting Officer*

*Acting Commissioner of Patents and Trademarks*